US009001007B2

(12) United States Patent
Park et al.

(10) Patent No.: US 9,001,007 B2
(45) Date of Patent: Apr. 7, 2015

(54) DISPLAY PANELS

(75) Inventors: Jae Hwa Park, Gumi-si (KR); YeoGeon Yoon, Seoul (KR); Swae-Hyun Kim, Asan-si (KR); Changil Tae, Seoul (KR)

(73) Assignee: Samsung Display Co., Ltd. (KR)

( * ) Notice: Subject to any disclaimer, the term of this patent is extended or adjusted under 35 U.S.C. 154(b) by 459 days.

(21) Appl. No.: 13/312,270

(22) Filed: Dec. 6, 2011

(65) Prior Publication Data

US 2012/0326950 A1 Dec. 27, 2012

(30) Foreign Application Priority Data

Jun. 27, 2011 (KR) ..... 10-2011-0062507

(51) Int. Cl.
*G09G 3/20* (2006.01)
*G09G 3/36* (2006.01)

(52) U.S. Cl.
CPC ..... *G09G 3/3607* (2013.01); *G09G 2300/0447* (2013.01); *G09G 2300/0452* (2013.01); *G09G 2300/0809* (2013.01); *G09G 2320/028* (2013.01); *G09G 2340/06* (2013.01)

(58) Field of Classification Search
None
See application file for complete search history.

(56) References Cited

U.S. PATENT DOCUMENTS 6,741,305 B2 * 5/2004 Nakagawa et al. ..... 349/106
7,466,380 B2 * 12/2008 Tsuchiya et al. ..... 349/114

FOREIGN PATENT DOCUMENTS

JP 9-230124 A 9/1997
JP 2002-071935 A 3/2002
JP 2007-233334 A 9/2007
KR 10-2010-0003564 A 1/2010
KR 10-0956342 B1 4/2010

* cited by examiner

*Primary Examiner* — Jonathan Boyd
*Assistant Examiner* — Parul Gupta
(74) *Attorney, Agent, or Firm* — Cantor Colburn LLP

(57) ABSTRACT

A display panel includes: a first base substrate on which a plurality of pixel areas are defined; a color filter layer including a plurality of color filters respectively in the plurality of pixel areas of the first base substrate, where four color filters having different colors are respectively in four pixel areas adjacent to each other; a plurality of pixel electrodes on the color filter layer, respectively in the plurality of pixel areas and electrically insulated from each other; a first area including a contact point at which the four adjacent pixel areas meet; a second base substrate which is combined with the first base substrate and faces the second base substrate; and a reference electrode on one of the first and second base substrates. At least one color filter among the four adjacent color filters includes a protruding part which overlaps the first area.

17 Claims, 11 Drawing Sheets

DISPLAY PANELS

This application claims priority to Korean Patent Application No. 10-2011-0062507, filed on Jun. 27, 2011, and all the benefits accruing therefrom under 35 U.S.C. §119, the entire contents of which are hereby incorporated by reference.

BACKGROUND OF THE INVENTION (1) Field of the Invention

The invention disclosed herein relates to a display panel, and more particularly, to a display panel for preventing an electrical short between adjacent pixels.

(2) Description of the Related Art

A liquid crystal display device is a display device having a liquid crystal layer between two transparent substrates and displays a desired image by adjusting a light transmittance for each pixel with the liquid crystal layer being driven.

Among operation modes of the liquid crystal display device, a vertical alignment mode displays an image when liquid crystal molecules are aligned vertically to transmit light with an electric field between two substrates. In a liquid crystal display device having the vertical alignment mode, a patterned vertical alignment ("PVA") mode improves a viewing angle of the liquid crystal display by a liquid crystal domain, which may align liquid crystal molecules in respectively different directions. The liquid crystal domain is formed by patterning a pixel electrode and a common electrode.

However, when a common electrode is patterned in order to form a plurality of liquid crystal domains in such a liquid crystal display device, the number of manufacturing processes of the liquid crystal display device is increased. Moreover, a normal liquid crystal domain may not be formed when misalignment occurs between the two substrates.

BRIEF SUMMARY OF THE INVENTION

The invention provides a display panel where a fine slit is formed in a pixel electrode, a reference electrode is adopted on an un-patterned vertical alignment liquid crystal display, and an electrical short between adjacent pixels is prevented.

Embodiments of the invention provide display panels which include: a first base substrate including a plurality of pixel areas defined thereon; a color filter layer including a plurality of color filters respectively in the plurality of pixel areas of the first base substrate, where four color filters having different colors from each other are respectively in four pixel areas adjacent to each other; a plurality of pixel electrodes on the color filter layer, respectively in the plurality of pixel areas and electrically insulated from each other; a first area including a contact point at which the four adjacent pixel areas meet; a second base substrate which is combined with the first base substrate, and faces the first base substrate; and a reference electrode on one of the first and second base substrates. At least one color filter among the four adjacent color filters includes a protruding part which overlaps the first area.

In some embodiments, the four color filters may include red, green, blue, and white color filters.

In other embodiments, the at least one color filter including the protruding part is the white color filter among the four color filters.

In still other embodiments, the white color filter may have a substantially rectangular shape, may include four vertexes at which adjacent sides of the rectangular shape respectively meet, and may include first to fourth protruding parts each having a three-fourths (¾) quadrant circular shape in a plan view. Each of the four vertexes of the white color filter is a center of the circular shape of a protruding part.

In even other embodiments, the protruding part partially may overlap each of the adjacent color filters, in the first area.

In yet other embodiments, each of the plurality of pixel areas may include a non-display area and a display area, and each of the red, green, and blue color filters may be in the display area of a respective pixel area.

In further embodiments, the white color filter may be in the display area of a respective pixel area, and in the non-display area of each of the pixel areas.

In still further embodiments, the display panels may further include a light screening layer on the second base substrate in the non-display area.

In even further embodiments, the plurality of pixel areas may be in a matrix arrangement on the first base substrate; and the four color filters repeat in a row direction and a column direction.

In yet further embodiments, the pixel electrode may include a first pixel electrode, and a second pixel electrode insulated electrically from the first pixel electrode.

In yet further embodiments, the first pixel electrode may include a first stem part which defines a plurality of first domains, and a plurality of first branch parts which extend from the first stem part and are parallel to each other in each of the first domains; and the second pixel electrode may include a second stem part which defines a plurality of second domains, and a plurality of second branch parts which extend from the second stem part and are parallel to each other in each of the second domains.

In yet further embodiments, the first area is a circular planar area having the contact point as a center of the circle; and the second pixel electrode in the first area may have a chamfered corner part.

In yet further embodiments, the display panels may further include: gate lines which extend in a first direction; and data lines which extend in a second direction orthogonal to the first direction and are electrically insulated from the gate lines.

In yet further embodiments, the second pixel electrode may include a first extension part which extends from one side of the second stem part, extends in the first direction and overlaps at least one adjacent gate line, and a second extension part which extends from the first extension part and extends in the second direction.

In yet further embodiments, a distal end part of the second extension part in the first area may be separated from the contact point and the second pixel electrode.

In yet further embodiments, the display panels may further include: a first thin film transistor on the first base substrate, where the first thin film transistor applies a data voltage to the first pixel electrode in response to a first gate signal; a second thin film transistor on the first base substrate, where the second thin film transistor applies the data voltage to the second pixel electrode in response to the first gate signal; a third thin film transistor which is turned on in response to a second gate signal; and a coupling capacitor in electrical connection to the second pixel electrode by the turned-on third thin film transistor.

In yet further embodiments, the display panels may further include a liquid crystal layer between the first pixel electrode and the reference electrode, and between the second pixel electrode and the reference electrode, where the liquid crystal layer includes vertically-aligned liquid crystal molecules.

In yet further embodiments, the display panel may further include: a first reactive mesogen layer between the liquid crystal layer and the first pixel electrode, and between the liquid crystal layer and the second pixel electrode; and a second reactive mesogen layer between the liquid crystal layer and the reference electrode.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION OF THE INVENTION

It will be understood that when an element or layer is referred to as being "on" or "connected to" another element or layer, the element or layer can be directly on or connected to another element or layer or intervening elements or layers.

Hereinafter, exemplary embodiments of the invention will be described in conjunction with the accompanying drawings.

Figure 1:
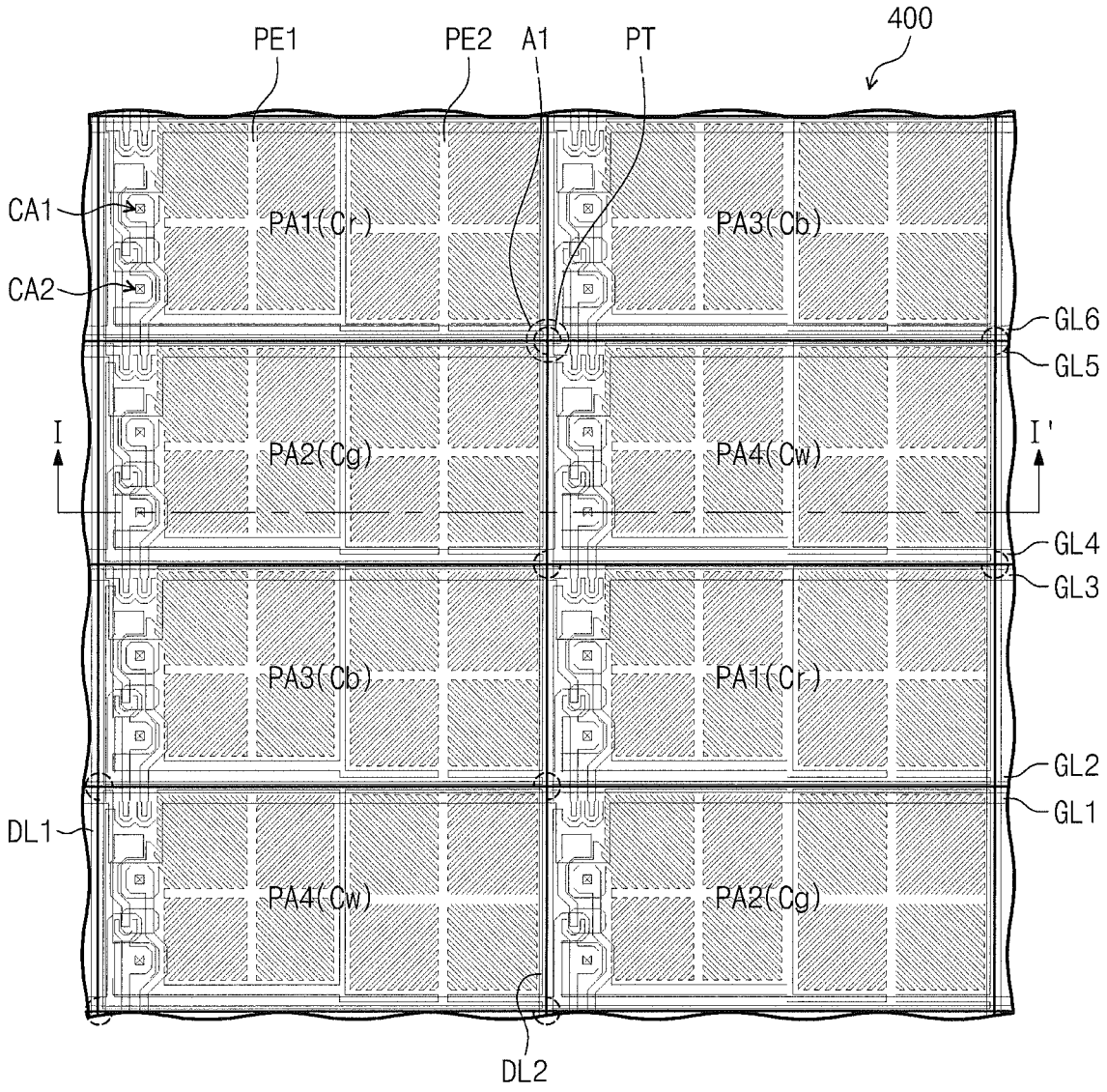
FIG. 1 is a plan view of an exemplary embodiment of a display panel according to the invention.
Figure 2:
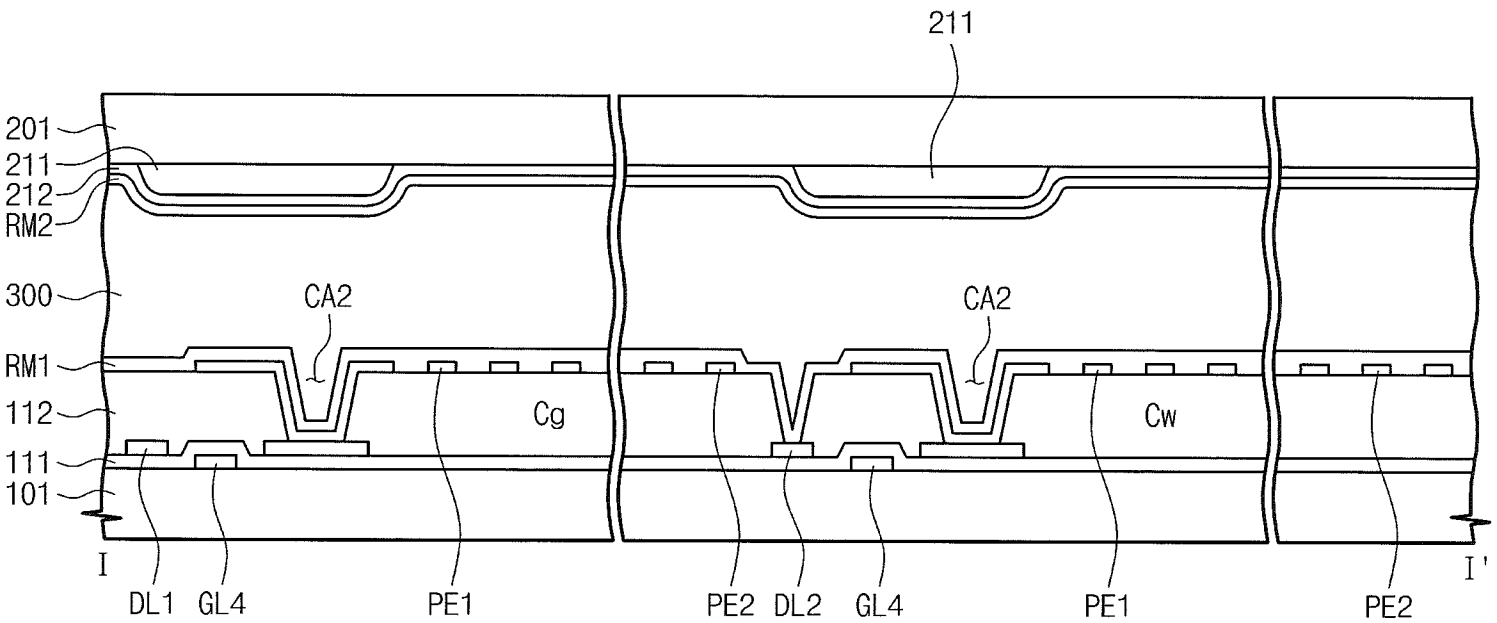
FIG. 2 is a cross-sectional view taken along line I-I' of FIG. 1.

FIG. 1 is a plan view of an exemplary embodiment of a display panel according to the invention. FIG. 2 is a cross-sectional view taken along line I-I' of FIG. 1.

Referring to FIGS. 1 and 2, the display panel 400 includes a first base substrate 101, a second base substrate 201 facing the first base substrate 101, and a liquid crystal layer 300 between the two substrates 101 and 201.

The display panel 400 further includes a plurality of gate lines and a plurality of data lines on the first base substrate 101. The plurality of data lines and the plurality of gate lines intersect with each other, with a gate insulation layer 111 therebetween so that the gate lines and the data lines are electrically insulated from each other. For convenience of description, first to sixth gate lines GL1 to GL6 among the plurality of gate lines are shown in FIG. 1 and first and second data lines DL1 and DL2 among the plurality of data lines are shown in FIG. 1.

Additionally, a plurality of pixel areas PA are defined in the first base substrate 101. The plurality of pixel areas PA may be in a matrix on the first base substrate 101, in the plan view.

Moreover, the display panel 400 further includes a color filter layer 112 including a plurality of color filters in the plurality of pixel areas PA of the first base substrate 101. As shown in FIG. 1, the adjacent four pixel areas (hereinafter, first to fourth pixel areas PA1, PA2, PA3, and PA4) may include four color filters Cr, Cg, Cb, and Cw respectively therein and having different colors from each other. As one exemplary embodiment of the invention, the four color filters Cr, Cg, Cb, and Cw may include red, green, blue, and white color filters, respectively.

In more detail, the red color filter Cr is formed on the first pixel area PA1 by patterning a first photoresist (not shown) mixed with a red pigment. Additionally, the green color filter Cg is formed on the second pixel area PA2 by patterning a second photoresist (not shown) mixed with a green pigment. The blue color filter Cb is formed on the third pixel area PA3 by patterning a third photoresist (not shown) mixed with a blue pigment. The white color filter Cw is formed on the fourth pixel area PA4 by patterning a fourth photoresist (not shown) mixed with a white pigment.

Then, the red, green, blue, and white color filters Cr, Cg, Cb, and Cw may be provided in an island form in the respective first to fourth pixel areas PA1 to PA4. As an island, the color filter is a discrete, individual member, and may be a single, unitary, indivisible member.

Moreover, at least one among the red, green, blue, and white color filters Cr, Cg, Cb, and Cw may include a protruding part PT covering (e.g., overlapping) a first area A1 where the first to fourth pixel areas PA1 to PA4 contact each other. As one exemplary embodiment of the invention, a structure where the white color filter Cw among the red, green, blue, and white color filters Cr, Cg, Cb, and Cw includes the protruding part PT is illustrated in FIG. 1. The structure of the white color filter Cw will be described in more detail with reference to FIGS. 5 and 6.

Moreover, besides the color filters, at least one thin transistor and pixel electrode may be provided on each of the pixel areas PA1 to PA4. As one exemplary embodiment of the invention, first to third thin film transistors and first and second pixel electrodes PE1 and PE2 are provided on each of the pixel areas PA1 to PA4. The first and second pixel electrodes PE1 and PE2 may be provided on the color filter layer 112.

First and second contact holes CA1 and CA2 are provided to extend through a thickness of each of the four color filters Cr, Cg, Cb, and Cw. The first pixel electrode PE1 is electrically connected to the first thin film transistor through the first contact hole CA1. The second pixel electrode PE2 is electrically connected to the second thin film transistor through the second contact hole CA2.

The structure of each of the pixel areas PA1 to PA4 will be described in more detail with reference to FIG. 3.

Moreover, the liquid crystal layer 300 includes a plurality of liquid crystal molecules having a dielectric anisotropy. The liquid crystal molecules are vertical alignment liquid crystal molecules between the first base substrate 101 and the second base substrate 201, which are arranged vertical (e.g., perpendicular) to the top side of the two substrates 101 and 201. Once an electric field is formed between the first base substrate 101 and the second base substrate 201, the liquid crystal molecules are rotated to a specific direction between the first base substrate 101 and the second base substrate 201, so that they transmit or screen light. The rotation may mean that the liquid crystal molecules lie in a direction parallel to the first base substrate 101 or the second base substrate 201.

The second base substrate 201 is combined with the first base substrate 101 with the liquid crystal layer 300 therebetween, while facing the first base substrate 101. The display panel 400 may further include a reference electrode 212 facing the first and second pixel electrodes PE1 and PE2, on the second base substrate 201. The reference electrode 212 may be on an entire surface of the second base substrate 201. Moreover, as another exemplary embodiment, the reference electrode 212 may be provided on the first base substrate 101. When the reference electrode 212 is provided on the first base substrate 101, it may be patterned to be electrically isolated from the first and second pixel electrodes PE1 and PE2.

The display panel 400 may further include a light screening layer 211 corresponding to a non-display area of each of the pixel areas, and between the second base substrate 201 and the reference electrode 212. The non-display area is an area where the first to third thin film transistors and the first and second contact holes CA1 and CA2 are in each of the pixel areas PA1 to PA4, and may be defined as an area that may not substantially control the liquid crystal molecules of the liquid crystal layer 300.

As shown in FIG. 2, the display panel 400 may further include first and second reactive mesogen layers RM1 and RM2 for pre-tilting the liquid crystal molecules of the liquid crystal layer 300.

The first reactive mesogen layer RM1 is between the first pixel electrode PE1 and the liquid crystal layer 300, and between the second pixel electrode PE2 and the liquid crystal layer 300. The second reactive mesogen layer RM2 is between the reference electrode 212 and the liquid crystal layer 300.

A reactive mesogen is a material having a similar property to a typical liquid crystal molecule and has a polymerized form of a reactive monomer. In one exemplary embodiment, the first and second reactive mesogen layers RM1 and RM2 including the reactive mesogen are formed by forming photoreactive monomers on the pixel electrodes PE1 and PE2 and the reference electrode 212, and applying light such as ultraviolet ("UV") light to polymerize the monomers. The polymer may extend in a predetermined direction to pre-tilt liquid crystal molecules. Accordingly, the liquid crystal molecules of the liquid crystal layer 300 may be pre-tilted at a predetermined angle, for example, about 85 degrees (°) to about 90°, by the first and second reactive mesogen layers RM1 and RM2. Here, the liquid crystal molecules of the liquid crystal layer 300 pre-tilted at the predetermined angle may have a faster response speed than liquid crystal molecules not pre-tilted when an electric field is formed.

Thus, the first and second reactive mesogen layers RM1 and RM2 may be used as a director of the liquid crystal layer 300.

The first and second reactive mesogen layers RM1 and RM2 may be a polymerization product of a compound including various reactive functional groups. In an exemplary embodiment, for example, the compound may be expressed as the following chemical formula 1.

$R_3$-J-K—$R_4$ Chemical formula 1

In Chemical Formula I, J and K each independently represent

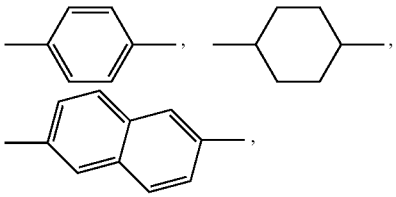

or a single bond, with the proviso J and K are not simultaneously a single bond. Hydrogen atoms of J and K may be independently substituted with F, Cl, a C1 to C12 alkyl group, or —$OCH_3$, provided that the substituted atom's normal valence is not exceeded. $R_3$ and $R_4$ may each independently represent a group of the formula

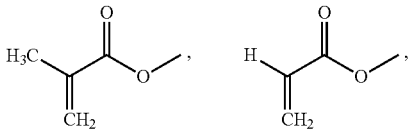

or a hydrogen atom, with the proviso that $R_3$ and $R_4$ are not simultaneously a hydrogen. "Alkyl" as used herein means a straight or branched chain, saturated, monovalent hydrocarbon group (e.g., methyl or hexyl).

Here, according to the illustrated embodiment of the invention, the display panel 400 has a structure including the additional first and second reactive mesogen layers RM1 and RM2 but is not limited thereto. Although not shown in the drawings, the reactive mesogen is not formed as one independent layer and is attached to a polymer constituting an alignment layer as a functional group, so that it may be formed in the alignment layer. In one exemplary embodiment, for example, the alignment layer may be formed of polyimide and the reactive mesogen may be attached to the side chain of the polyimide. In this case, a pre-tilt angle of the liquid crystal molecules in the liquid crystal layer 300 may be controlled by the reactive mesogen, so that a response speed of the liquid crystal molecules may be improved.

Figure 3:
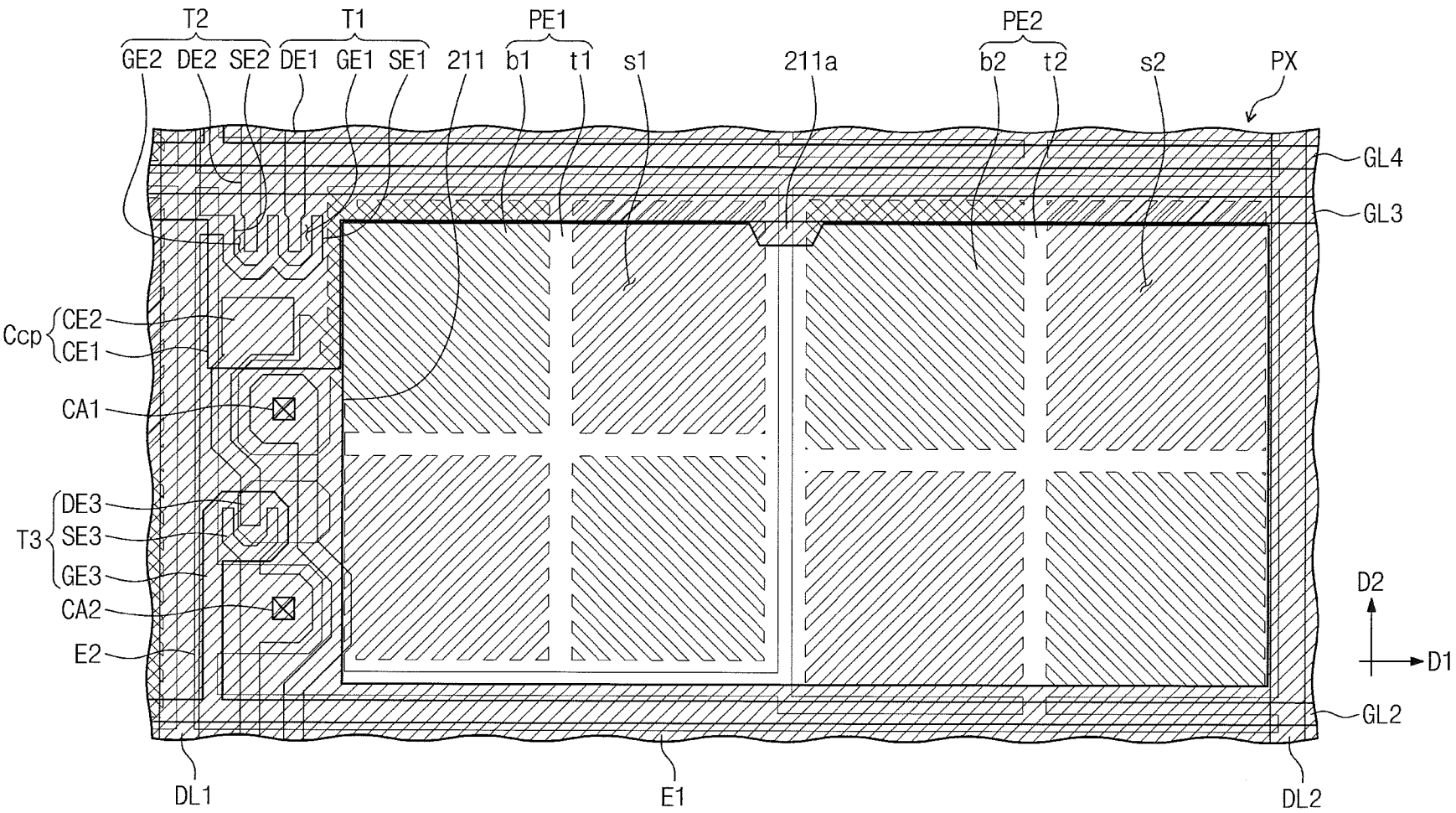
FIG. 3 is a plan view of an exemplary embodiment of one of a plurality of pixel areas shown in FIG. 1.

FIG. 3 is a plan view of an exemplary embodiment of one of a plurality of pixel areas shown in FIG. 1. The structure of one pixel area will be described with reference to FIG. 3. Since other pixel areas have similar structures to the one pixel area, their description will be omitted. Additionally, hereinafter, all components in the pixel area are collectively referred to as a pixel PX.

Referring to FIG. 3, a plurality of gate lines GL2, GL3, and GL4 extending in a first direction D1 and a plurality of data lines DL1 and DL2 extending in a second direction D2 orthogonal to the first direction D1 are provided on the first base substrate 101 of FIG. 2. The gate lines GL2, GL3, and GL4 intersect the data lines DL1 and DL2, such that the gate lines gate lines GL2, GL3, and GL4 and the data lines DL1 and DL2 are insulated from each other.

A pixel area of a roughly rectangular planar shape may be defined on the first base substrate 101. As another exemplary embodiment of the invention, the shape of the pixel area may be changed into various shapes such as a Z shape, a V shape, and so on.

The pixel PX may be provided on the pixel area and may include first to third thin film transistors T1, T2, and T3, the first and second pixel electrodes PE1 and PE2, and a coupling capacitor Ccp.

The first thin film transistor T1 includes a first gate electrode GE1 diverged from the third gate line GL3 among the gate lines GL2, GL3, and GL4, a first source electrode SE1 diverged from the first data line DL1 among the data lines DL1 and DL2, and a first drain electrode DE1 spaced a predetermined distance apart from the first source electrode SE1. The first drain electrode DE1 extends in the second direction D2 to be electrically connected to the first pixel electrode of the next adjacent pixel.

Moreover, the second thin film transistor T2 includes a second gate electrode GE2 diverged from the third gate line GL3, a second source electrode SE2 diverged from the first data line DL1, and a second drain electrode DE2 spaced a predetermined distance apart from the second source electrode SE2. The second drain electrode DE2 extends in the second direction D2 to be electrically connected to the second pixel electrode PE2 of the next adjacent pixel.

The third thin film transistor T3 includes a third gate electrode GE3 diverged from the second gate line GL2 among the gate lines GL2, GL3, and GL4, a third source electrode SE3 extending from the second drain electrode DE2, and a third drain electrode DE3 spaced a predetermined distance apart from the third source electrode SE3.

The coupling capacitor Ccp includes a first electrode CE1 extending from the first gate electrode GE 1, and a second electrode CE2 extending from the third drain electrode DE3 to partially overlap the first gate electrode GE1. The gate insulation layer 111 of FIG. 2 interposed between the first and second electrodes CE1 and CE2 may serve as a dielectric of the coupling capacitor Ccp.

In order to divide the pixel area PA into a plurality of first domains, the first pixel electrode PE1 includes a first stem part t1, and a plurality of first branch parts b1 extending from the first stem part t1 in a radial shape. Some first branches b1 extend to face (e.g., overlap) the first drain electrode DE1 and are electrically connected to the first drain electrode DE1 through the first contact hole CA1.

Moreover, the first stem part t1 may be provided with a cross shape like in the illustrated embodiment of the invention. In this case, the pixel area PA may be divided into a plurality of domains by the first stem part t1. The plurality of first branch parts b1 extend in parallel to each other within each of the domains divided by the first stem part t1, and are arranged being spaced from each other. As one exemplary embodiment of the invention, the first branch parts b1 may extend in a direction forming an angle of about 45° with respect to the respective first and second directions D1 and D2. In the first branch parts b1, the respectively adjacent first branches b1 are spaced about a micrometer distance apart from each other to form a plurality of first slits s1. The liquid crystal molecules of the liquid crystal layer 300 may be pre-tilted in respectively different directions in each of the domains by the plurality of first slits s1.

The second pixel electrode PE2 includes a second stem part t2, and a plurality of second branch parts b2 protruding from and extending in a radial shape from the second stem part t2. The second stem part t2 may be provided with a cross shape like in the illustrated embodiment of the invention. In this case, the pixel area PA may be divided into a plurality of second domains by the second stem part t2. The plurality of second branch parts b2 extend in parallel to each other within each of the domains divided by the second stem part t2 and are arranged being spaced from each other. In the second branch parts b2, the respectively adjacent second branches b2 are spaced about a micrometer distance apart from each other to form a plurality of second slits s2. The liquid crystal molecules of the liquid crystal layer 300 may be pre-tilted in respectively different directions in each of the domains by the plurality of second slits s2.

Furthermore, the second pixel electrode PE2 includes a first extension part E1 diverged from the second stem part t2 and extending parallel to the second gate line GL2, and a second extension part E2 extending from one end of the first extension part E1 to be parallel to the first data line DL1. In the plan view, the first extension part E1 overlaps the second gate line GL2 and the second extension part E2 partially overlaps the first data line DL1. Additionally, a portion of the second extension part E2 extends to face (e.g., overlap) the second drain electrode DE2 and is electrically connected to the second drain electrode DE2 through the second contact hole CA2.

Moreover, the reference electrode 212 of FIG. 2 is on the second base substrate 201. As one exemplary embodiment of the invention, the reference electrode 212 is provided with a substantially flat shape on the second base substrate 201 without a slit part. The reference electrode 212 may be a single, unitary, indivisible member having no openings extending through a thickness thereof.

In the plan view, the light screening layer 211 covers an area including the first to third thin film transistors T1 to T3, the coupling capacitor Ccp, the first and second contact holes CA1 and CA2, the second to fourth gate lines GL2, GL3, and GL4, and the first and second data lines DL1 and DL2. Additionally, the light screening layer 211 may further include a protrusion light screening part 211*a* covering an area where the first and second pixel electrodes PE1 and PE2 are spaced from each other and intersect the third gate line GL3. Accordingly, the protrusion light screening part 211*a* may reduce or effectively prevent light leak at the area between the first and second pixel electrodes PE1 and PE2 which intersects the third gate line GL3.

Hereinafter, operations of the pixel PX will be described with reference to FIG. 4.

The first and second thin film transistors T1 and T2 are provided in each pixel area as shown in FIG. 3. According to the illustrated embodiment, the first and second thin film transistors T1 and T2 in one pixel area are not electrically connected to the first and second pixel electrodes PE1 and PE2 in the one pixel area, but are electrically connected to the first and second pixel electrodes PE1 and PE2 in an adjacent pixel area. However, for operation description of the pixel PX, as shown in FIG. 4, the first and second thin film transistors T1 and T2 connected to the first and second pixel electrodes PE1 and PE2 of each pixel PX is included in the pixel PX to represent one pixel in an equivalent circuit.

Figure 4:
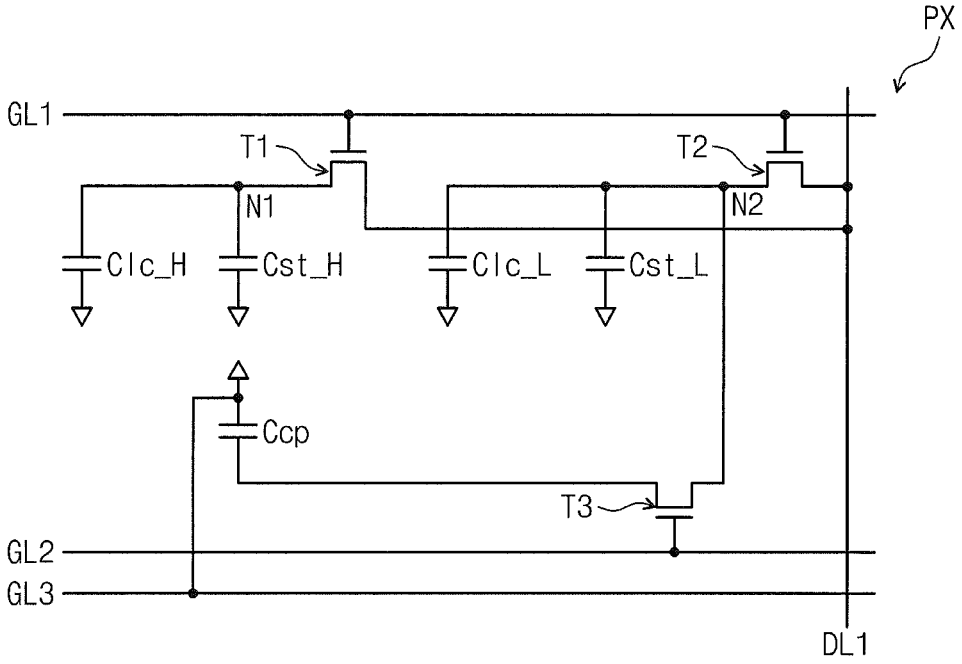
FIG. 4 is an equivalent circuit of the pixel in FIG. 3.

FIG. 4 is an equivalent circuit of the pixel in FIG. 3.

Referring to FIG. 4, when a gate-on-voltage is applied to the first gate line GL1, the first and second thin film transistors T1 and T2 are simultaneously turned on, and a data voltage applied to the first data line DL1 is charged on the first and second liquid crystal capacitors Clc_H and Clc_L through the turned-on first and second thin film transistors T1 and T2. Accordingly, the electric potentials of first and second nodes N1 and N2 become identical.

Here, the data voltage charged on the first and second liquid crystal capacitors Clc_H and Clc_L controls the alignment directions of liquid crystal molecules in the liquid crystal layer 300 of FIG. 2.

Additionally, the first main liquid crystal capacitor Cst_H and the second main liquid crystal capacitor Cst_L may serve to maintain the data voltage charged on the first and second liquid crystal capacitors Clc_H and Clc_L for one frame.

Later, when a gate-off-voltage is applied to the first gate line GL1 and a gate-on-voltage is applied to the second gate line GL2, the first and second thin film transistors T1 and T2 are turned off and the thin film transistor T3 is turned on.

Once the third thin film transistor T3 is turned on, the second liquid crystal capacitor Clc_L is electrically connected to the coupling capacitor Ccp through the third thin film transistor T3 so that the second liquid crystal capacitor Clc_L and the coupling capacitor Ccp share the charging.

In more detail, a first electrode of the coupling capacitor Ccp is connected to the third gate line GL3 and a second electrode is connected to a third drain electrode of the third thin film transistor T3. During a turn-on interval of the third thin film transistor T3, the gate-off-voltage is applied to the third gate line GL3. Accordingly, the electric potential of the second node N2 is down clue to the charge sharing of the coupling capacitor Ccp and the second liquid crystal capacitor Clc_L during a turn-on interval of the third thin film transistor T3. Later, if even the third thin film transistor T3 is turned off, the electric potential of the second node N2 maintains a down state.

Accordingly, when the second liquid Crystal capacitor Clc_L and the coupling capacitor Ccp share the charging by the third thin film transistor T3, a data voltage charged on the second liquid crystal capacitor Clc_L is reduced. As a result, a difference occurs between the data voltage charged on the first liquid crystal capacitor Clc_H and the data voltage charged on the second liquid crystal capacitor Clc_L. That is, the data voltage charged on the first liquid crystal capacitor Clc_H has a higher voltage level than that charged on the second liquid crystal capacitor Clc_L.

Thus, when the data voltages charged on the respective first and second liquid crystal capacitors Clc_H and Clc_L in one pixel PX has respectively different values, side visibility may be improved. In more detail, when the data voltages corresponding to two gamma curves having respectively different gamma values obtained from one image information are stored on the first and second liquid crystal capacitors Clc_H and Clc_L, a total gamma curve of the pixel PX including the first and second liquid crystal capacitors Clc_H and Clc_L is a result obtained by synthesizing the two gamma curves. One pair of gamma curves may include voltages that a synthetic gamma curve at the front becomes closer to the reference gamma curve at the front and may include voltages that a synthetic gamma curve at the side becomes closer to the reference gamma curve at the front, thereby improving side visibility.

Figure 5:
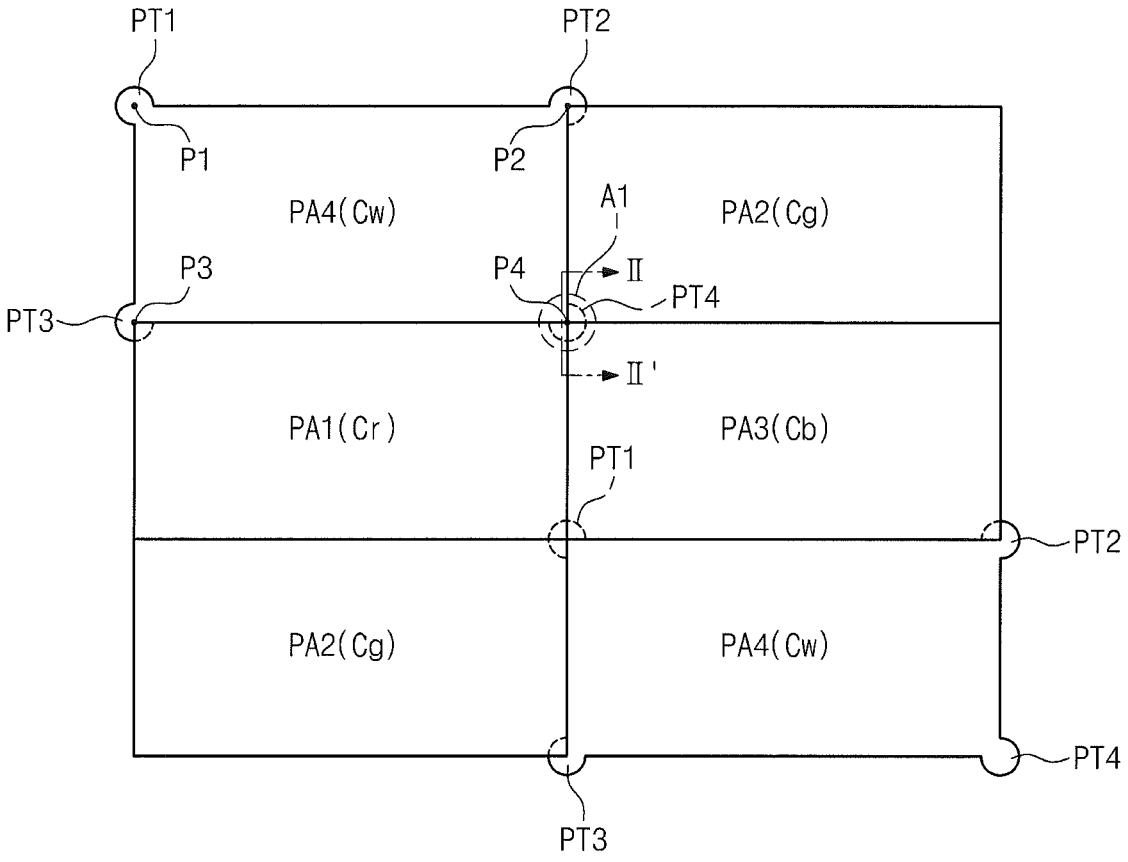
FIG. 5 is a plan view illustrating an exemplary embodiment of the red, green, blue, and white color filters of FIG. 1.
Figure 6:
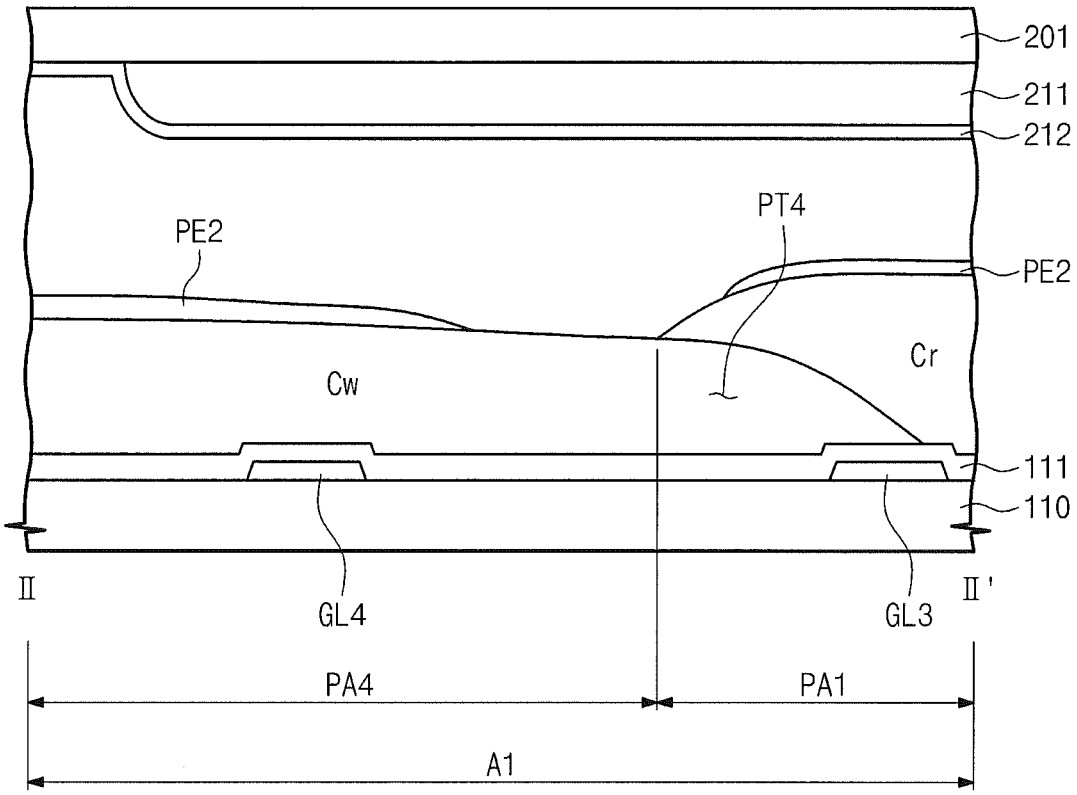
FIG. 6 is a cross-sectional view taken along line II-II' of FIG. 5.

FIG. 5 is a plan view illustrating an exemplary embodiment of the red, green, blue, and white color filters of FIG. 1. FIG. 6 is a cross-sectional view taken along the line II-II' of FIG. 5.

Referring to FIGS. 5 and 6, red, green, blue, and white color filters Cr, Cg, Cb, and Cw are respectively provided in adjacent first to fourth pixel areas PA1, PA2, PA3, and PA4. The first and second contact holes CA1 and CA2 are provided to each of the red, green, blue, and white color filters Cr, Cg, Cb, and Cw.

At least one of the red, green, blue, and white color filters Cr, Cg, Cb, and Cw includes a protruding part PT extending to cover a first area A1 where the red, green, blue, and white color filters Cr, Cg, Cb, and Cw contact or meet.

As in the illustrated embodiment of the invention, the white color filter Cw among the red, green, blue, and white color filters Cr, Cg, Cb, and Cw includes first to fourth protruding parts PT1, PT2, PT3, and PT4 covering the first area A1.

In more detail, the fourth pixel area PA4 is defined with a rectangular shape by four edges and includes four vertexes P1, P2, P3, and P4 formed when virtual respective adjacent two edges meet each other. In the plan view, the vertexes P1, P2, P3, and P4 are centers of the first to fourth protruding parts PT1, PT2, PT3, and PT4. The first to fourth protruding parts PT1, PT2, PT3, and PT4 are effectively three-fourths (¾) of a circle, that is, having a ¾ quadrants shape, with the vertexes P1, P2, P3, and P4 being the centers of the circles.

Also, in the plan view, the first to fourth protruding parts PT1, PT2, PT3, and PT4 may partially overlap each of the adjacent red, green, and blue color filters Cr, Cg, and Cb. In more detail, one quadrant of the first to fourth protruding parts PT1, PT2, PT3, and PT4 having the ¾ quadrants shape overlaps the red color filter Cr, another quadrant overlaps the green color filter Cg, and the remaining quadrant overlaps the blue color filter Cb.

As shown in FIG. 6, in the first area A1 including a portion where the first and fourth pixel areas PA1 to PA4 contact each other, the white color filter Cw may include the fourth protruding part PT4 extending from the fourth pixel area P4 to the first pixel area PA1. The fourth protruding part PT4 may begin at a position aligned with an edge and/or a vertex of the red color filter Cr.

In the first area A1, the fourth protruding part PT4 partially overlaps the red color filter Cr. In more detail, the red color filter Cr may be provided on the fourth protruding part PT4 in the first area A1. That is, in the illustrated embodiment, the fourth protruding part PT4 is between the gate insulating layer 111 and the red color filter Cr of the adjacent first pixel area PA1. According to an order of the manufacturing processes of the red and white color filters Cr and Cw, a position of the red color filter Cr may vary. That is, when the red color filter Cr is formed before the white color filter Cw, the fourth protruding part PT4 is provided on the red color filter Cr, and the red color filter Cr is between the gate insulating layer 111 and the fourth protruding part PT4.

Additionally, the fourth protruding part PT4 may be in a non-display area having the light screening layer 211 in the first pixel area PA1.

Figure 7:
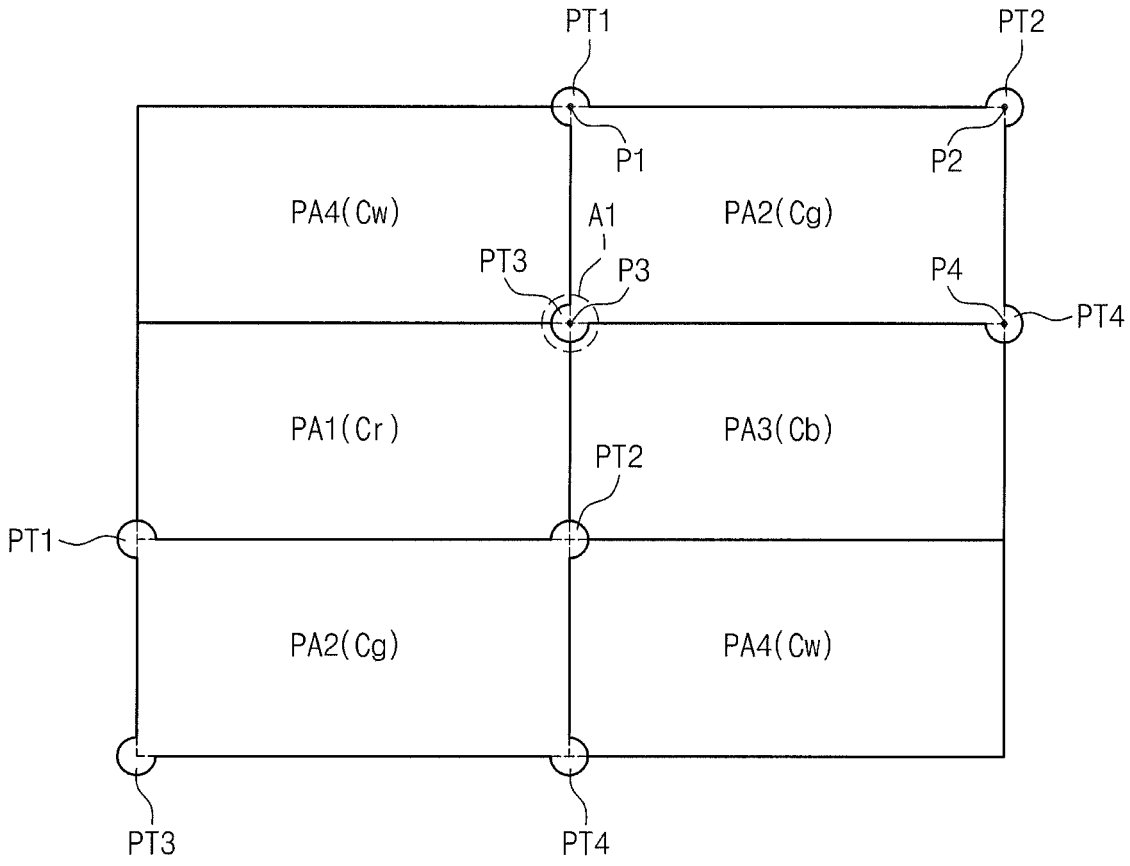
FIG. 7 is a plan view illustrating another exemplary embodiment of red, green, blue, and white color filters according to the invention.

FIG. 7 is a plan view illustrating another exemplary embodiment of red, green, blue, and white color filters according to the invention. However, like reference numbers refer to like elements in FIGS. 5 and 7 and their detailed description will be omitted.

Referring to FIG. 7, the green color filter Cg among the red, green, blue, and white color filters Cr, Cg, Cb, and Cw includes first to fourth protruding parts PT1, PT2, PT3, and PT4 covering the first area A1.

In more detail, the second pixel area PA2 is defined with a rectangular shape by four edges and may include four vertexes P1, P2, P3, and P4 formed when virtual respective adjacent two edges meet each other. In the plan view, the vertexes P1, P2, P3, and P4 are centers of the first to fourth protruding parts PT1, PT2, PT3, and PT4. The first to fourth protruding parts PT1, PT2, PT3, and PT4 are effectively ¾ of a circle, that is, having a ¾ quadrants shape, with the vertexes P1, P2, P3, and P4 being the centers of the circles.

Each of the color filters may have a substantially rectangular main shape and include four vertexes at which adjacent sides of the rectangular shape respectively meet. For the color filter including the first to fourth protruding parts PT1, PT2, PT3, and PT4, the main shape of the color filter and the first to fourth protruding parts PT1, PT2, PT3, and PT4 collectively form a single, unitary, indivisible member.

Additionally, in the plan view, the first to fourth protruding parts PT1, PT2, PT3, and PT4 may partially overlap the red, blue, and white color filters Cr, Cb, and Cw. In more detail, one quadrant of the first to fourth protruding parts PT1, PT2, PT3, and PT4 having the ¾ quadrants shape overlaps the red color filter Cr, another quadrant overlaps the blue color filter Cb, and the remaining quadrant overlaps the white color filter Cw.

Although it is shown in FIGS. 5 and 7 that the first to fourth protruding parts PT1, PT2, PT3, and PT4 are a portion of the white color filter Cw or the green color filter Cg among the red, green, blue, and white color filters Cr, Cg, Cb, and Cw, the first to fourth protruding parts PT1, PT2, PT3, and PT4 may be a portion of the red color filter Cr or the blue color filter Cb.

Figure 8:
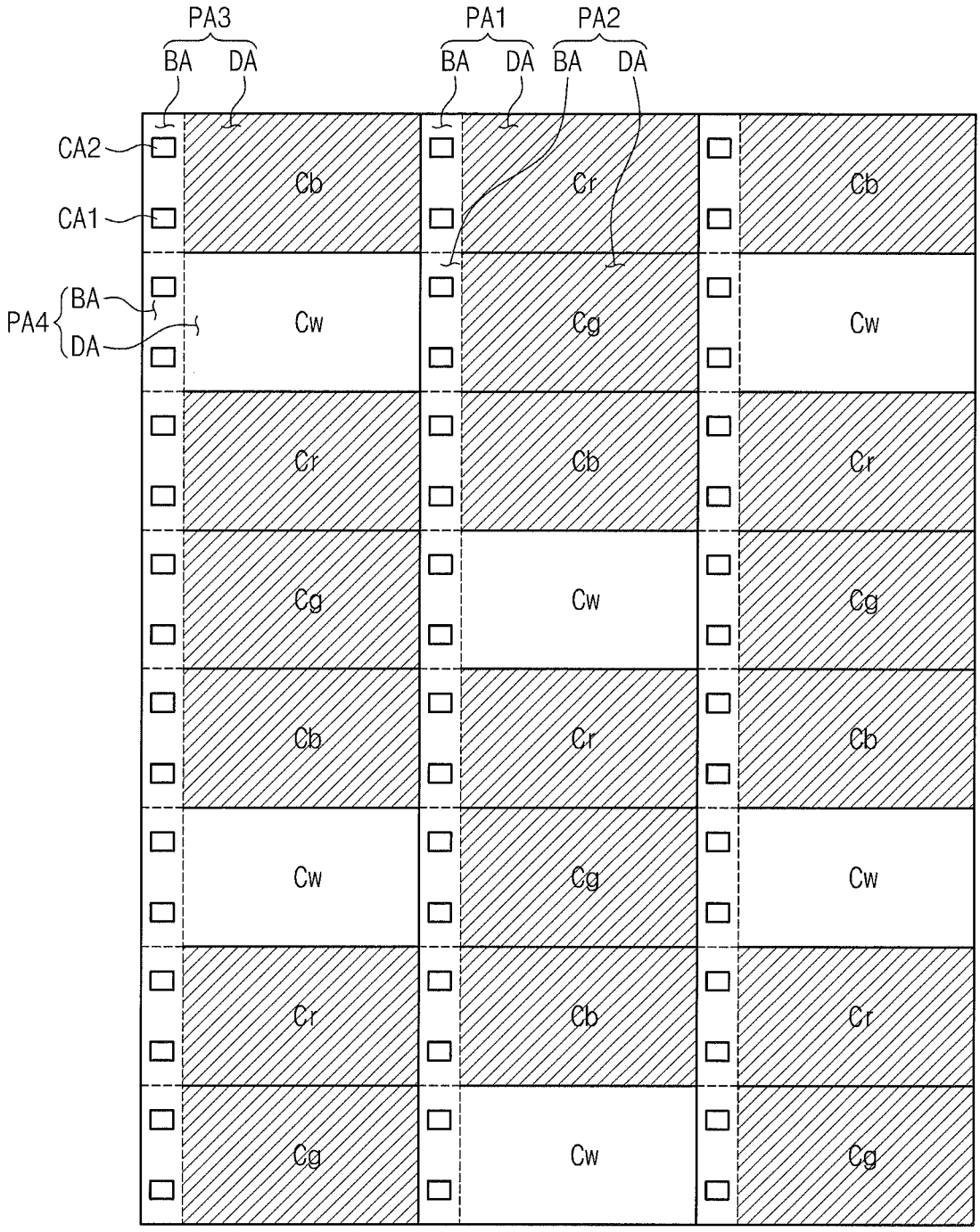
FIG. 8 is a plan view illustrating still another exemplary embodiment of red, green, blue, and white color filters according to the invention.

FIG. 8 is a plan view illustrating still another exemplary embodiment of red, green, blue, and white color filters according to the invention.

Referring to FIG. 8, the red, green, blue, and white color filters Cr, Cg, Cb, and Cw are provided on the first to fourth pixel areas PA1, PA2, PA3, and PA4, respectively.

Each of the first to fourth pixel areas PA1, PA2, PA3, and PA4 is divided into a non-display area BA and a display area DA. The display areas DA of the first to fourth pixel areas PA1, PA2, PA3, and PA4 include the red, green, blue, and white color filters Cr, Cg, Cb, and Cw, respectively.

The non-display areas BA of the first to fourth pixel areas PA1, PA2, PA3, and PA4 include the white color filter Cw. In the non-display area BA, the first and second contact holes CA1 and CA2 may be provided in the white color filter Cw.

In one exemplary embodiment, the white color filter Cw in the non-display areas BA and the white color filter Cw in the display areas DA may be simultaneously formed through the same process.

Once the white color filter Cw is in the non-display area BA in each pixel area, an interface where the four color filters having respectively different colors meet each other in the first area A1 (i.e., the first to fourth pixel areas PA1 to PA4 contact) may be reduced or effectively prevented.

Figure 9:
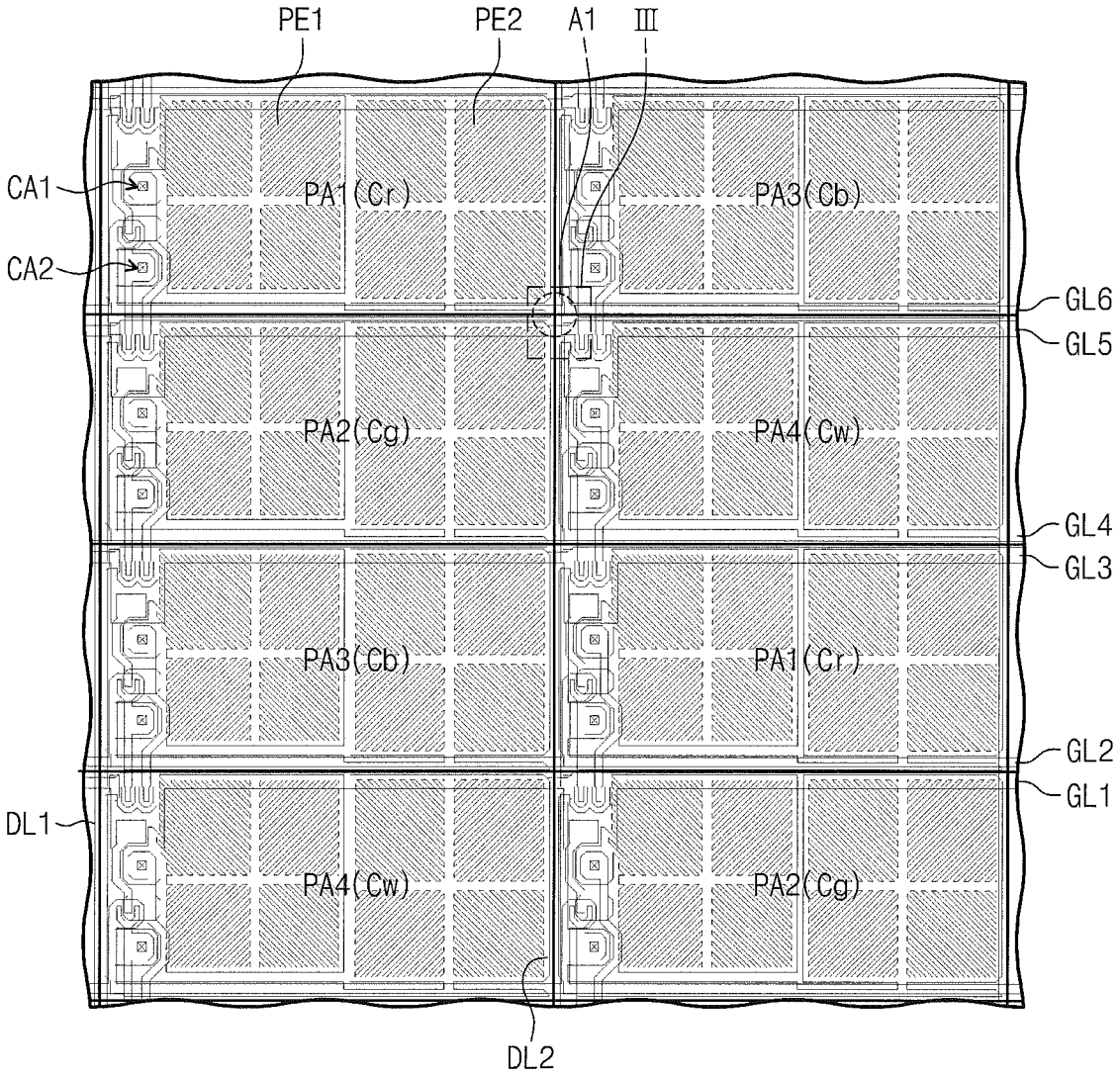
FIG. 9 is a plan view of another exemplary embodiment of a display panel according to the invention.
Figure 10:
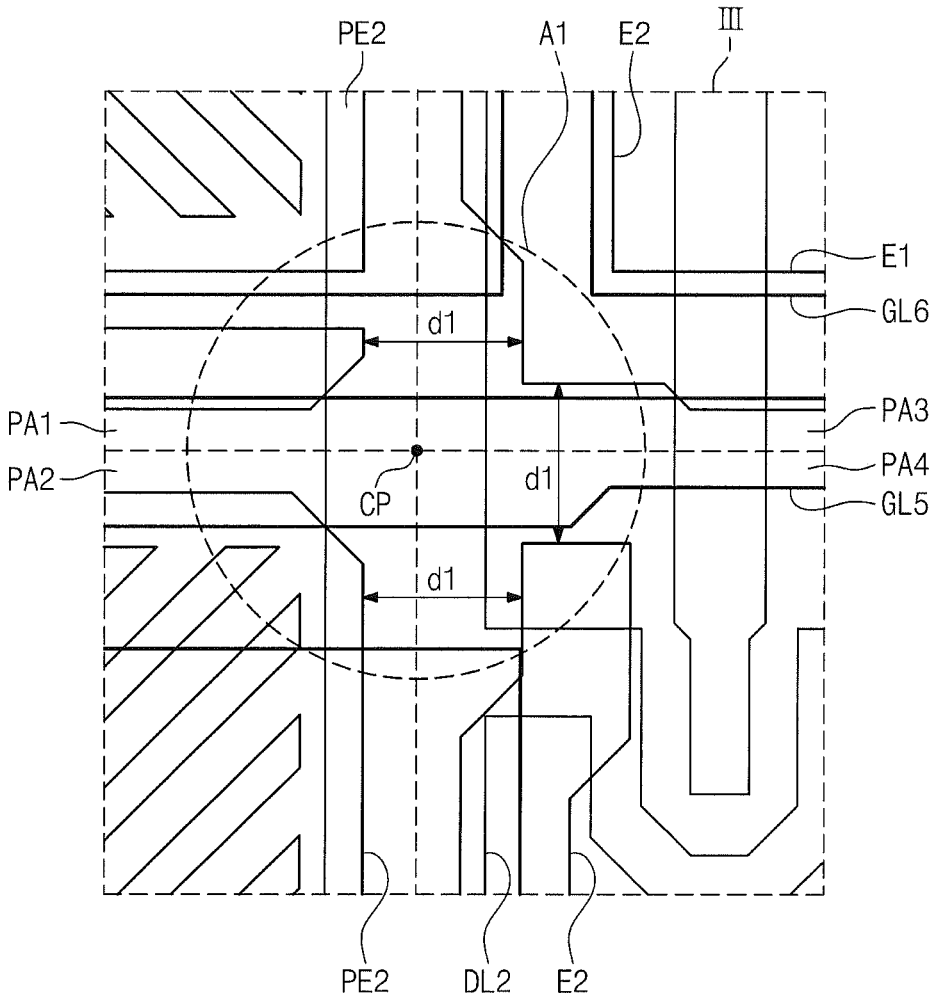
FIG. 10 is an enlarged view of an exemplary embodiment of portion III in FIG. 9.

FIG. 9 is a plan view of another exemplary embodiment of a display panel according to the invention. FIG. 10 is an enlarged view of an exemplary embodiment of portion III in FIG. 9. Like reference numerals refer to like elements through FIGS. 1 and 9 and their detailed description will be omitted.

Referring to FIGS. 9 and 10, when a contact point where the first to fourth pixel areas PA1, PA2, PA3, and PA4 meet is referred to as "CP," an area within a predetermined distance from the contact point CP as the center of a circle may be defined as the first area A1. The second pixel electrode PE2 in the first area A1 has a chamfered corner part. In more detail, the edge of the second pixel electrode PE2 is partially cut in an area where the first pixel area PA1 and the first area A1 overlap. Moreover, the edge of the second pixel electrode PE2 is partially cut in an area where the second pixel area PA2 and the first area A1 overlap.

A second extension part E2 of the second pixel electrode PE2 in the third pixel area PA3 may be shifted in a direction away from the contact point CP. As one exemplary embodiment of the invention illustrated in FIG. 10, the second extension part E2 is shifted to the right so that it may be spaced apart from the second pixel electrode PE2 of the second pixel area PA2 by more than a first interval d1 in the first area A1.

Additionally, the second extension part E2 of the second pixel electrode PE2 in the fourth pixel area PA4 may be shifted in a direction away from the contact point CP. As one exemplary embodiment of the invention, the second extension part E2 is shifted to the right so that it may be spaced apart from the second pixel electrode PE2 of the second pixel area PA2 by more than the first interval d1 in the first area A1.

The second extension part E2 of the second pixel electrode PE2 in the fourth pixel area PA4 may be spaced apart from the first extension part E1 of the second pixel electrode PE2 in the third pixel area PA3 by more than the first interval d1, in the second direction D2.

As one exemplary embodiment of the invention, the first interval d1 may be about 1.1 micrometers (μm). Additionally, the minimum distance between the contact point CP and the pixel electrodes in the first to fourth pixel areas PA1 to PA4 may be between about 6.5 μm and about 10.5 μm.

Therefore, the pixel electrodes in the first to fourth pixel areas PA1 to PA4 which are separated from each other in the first area A1, may prevent an electrical short in the first area A1.

Figure 11:
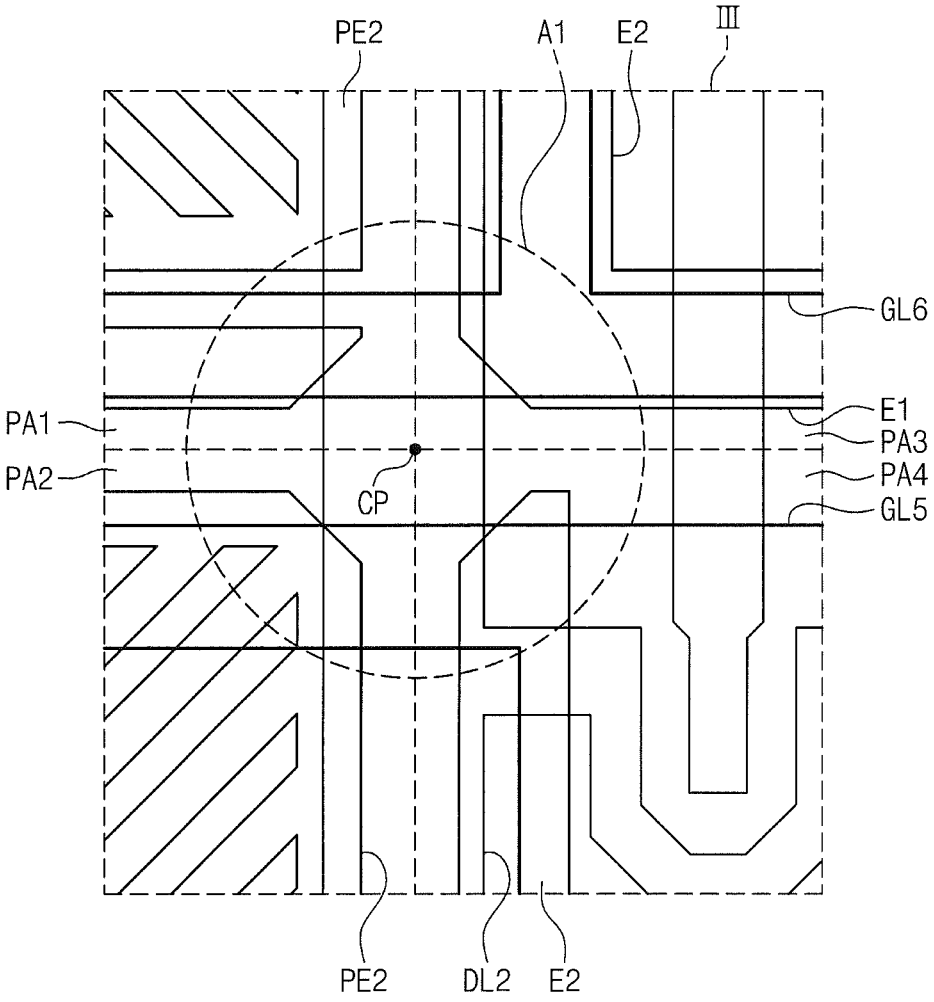
FIG. 11 is an enlarged view of another exemplary embodiment of portion III according to the invention.

FIG. 11 is an enlarged view of another exemplary embodiment of portion III according to the invention. Like reference numerals refer to like elements through FIGS. 10 and 11.

Referring to FIG. 11, when a contact point where the first to fourth pixel areas PA1, PA2, PA3, and PA4 meet is referred to as "CP," an area within a predetermined distance from the contact point CP as the center of a circle may be defined as a first area A1. The second pixel electrode PE2 in the first area A1 may have a chamfered corner part. In more detail, the edge of the second pixel electrode PE2 is partially cut in an area where the first pixel area PA1 and the first area A1 overlap. Additionally, the edge of the second pixel electrode PE2 is partially cut in an area where the second pixel electrode PA2 and the first area A1 overlap.

Moreover, the edge of the second extension part E2 of the second pixel electrode PE2 in the third pixel area PA3 is partially cut and the edge of the second extension part E2 of the second pixel electrode PE2 in the fourth pixel area PA4 is partially cut.

Accordingly, the shortest distance between the contact point CP and the pixel electrodes in the first to fourth pixel areas PA1 to PA4 may be maintained in a range of about 6.5 μm to about 10.5 μm.

Therefore, the pixel electrodes in the first to fourth pixel areas PA1 to PA4 are separated from each other in the first area A1, may prevent an electrical short in the first area A1.

As mentioned above, in a structure where color filters and pixel electrodes are provided on a first base substrate, at least one of four color filters includes a protruding part extending into a first area having a contact point where four pixel areas meet each other. Accordingly, an electrical short in the first area, of the pixel electrodes in each pixel area, may be reduced or effectively prevented.

The above-disclosed subject matter is to be considered illustrative, and not restrictive, and the appended claims are intended to cover all such modifications, enhancements, and other embodiments, which fall within the true spirit and scope of the invention. Thus, to the maximum extent allowed by law, the scope of the invention is to be determined by the broadest permissible interpretation of the following claims and their equivalents, and shall not be restricted or limited by the foregoing detailed description.

What is claimed is:

1. A display panel comprising:

a first base substrate including a plurality of pixel areas which are defined thereon;

a color filter layer comprising a plurality of color filters respectively in the plurality of pixel areas of the first base substrate, wherein color filters in four pixel areas adjacent to each other among the plurality of pixel areas, respectively have four different colors;

a plurality of pixel electrodes on the color filter layer, respectively in the plurality of pixel areas and electrically insulated from each other;

a first area including a contact point at which the four adjacent pixel areas meet;

a second base substrate which is combined with the first base substrate, and faces the first base substrate; and a reference electrode on one of the first and second base substrates, wherein a first color filter among the four adjacent color filters comprises a protruding part which overlaps the first area, wherein the protruding part has a three-fourths quadrant circular shape in a plan view, one quadrant of the protruding part overlaps a second color filter among the four adjacent color filters in the first area, another quadrant overlaps a third color filter among the four adjacent color filters in the first area, and a remaining quadrant overlaps a fourth color filter among the four adjacent color filters in the first area.

2. The display panel of claim 1, wherein the first color filter comprises a white color filter, the second color filter comprises a red color filter, the third color filter comprises a green color filter, and the fourth color filter comprises a blue color filter.

3. The display panel of claim 2, wherein the white color filter has a substantially rectangular shape, includes four vertexes at which adjacent sides of the rectangular shape respectively meet; and comprises first to fourth protruding parts each having the three-fourths quadrant circular shape in the plan view, wherein each of the four vertexes of the white color filter is a center of the circular shape of a protruding part of the first to fourth protruding parts.

4. The display panel of claim 2, wherein each of the plurality of pixel areas comprises a non-display area and a display area, and each of the red, green, and blue color filters is in the display area of a respective pixel area.

5. The display panel of claim 4, wherein the white color filter is in the display area of a respective pixel area, and in the non-display area of each of the pixel areas.

6. The display panel of claim 5, further comprising a light screening layer on the second base substrate in the non-display area.

7. The display panel of claim 1, wherein the plurality of pixel areas are in a matrix arrangement on the first base substrate; and the four color filters repeat in a row direction and in a column direction of the matrix arrangement.

8. The display panel of claim 1, wherein the pixel electrode comprises a first pixel electrode, and a second pixel electrode electrically insulated from the first pixel electrode.

9. The display panel of claim 8, wherein the first pixel electrode comprises:

a first stem part which defines a plurality of first domains, and a plurality of first branch parts which extend from the first stem part and are parallel to each other in each of the first domains; and the second pixel electrode comprises:

a second stem part which define a plurality of second domains, and a plurality of second branch parts which extend from the second stem part and are parallel to each other in each of the second domains.

10. The display panel of claim 9, wherein the first area is a circular planar area having the contact point as the center of the circle; and the second pixel electrode in the first area has a chamfered corner part.

11. The display panel of claim 9, further comprising:

gate lines which extend in a first direction; and data lines which extend in a second direction orthogonal to the first direction and are electrically insulated from the gate lines.

12. The display panel of claim 11, wherein the second pixel electrode further comprises:

a first extension part which extends from one side of the second stem part, extends in the first direction and overlaps at least one adjacent gate line; and a second extension part which extends from the first extension part and extends in the second direction.

13. The display panel of claim 12, wherein a distal end of the second extension part in the first area is separated from the contact point and the second pixel electrode.

14. The display panel of claim 10, further comprising:

a first thin film transistor on the first base substrate, wherein the first thin film transistor applies a data voltage to the first pixel electrode in response to a first gate signal;

a second thin film transistor on the first base substrate, wherein the second thin film transistor applies the data voltage to the second pixel electrode in response to the first gate signal;

a third thin film transistor which is turned on in response to a second gate signal; and a coupling capacitor in electrical connection to the second pixel electrode by the turned-on third thin film transistor.

15. The display panel of claim 9, further comprising a liquid crystal layer between the first pixel electrode and the reference electrode, and between the second pixel electrode and the reference electrode, the liquid crystal comprising vertically-aligned liquid crystal molecules.

16. The display panel of claim 15, further comprising:

a first reactive mesogen layer between the liquid crystal layer and the first pixel electrode, and between the liquid crystal layer and the second pixel electrode; and a second reactive mesogen layer between the liquid crystal layer and the reference electrode.

17. A method of forming a display panel, the method comprising:

defining a plurality of pixel areas on a first substrate;

disposing first to fourth color filters having different colors from each other, within first to fourth pixel areas, respectively, wherein the first to fourth pixel areas are adjacent to each other and meet at a contact point; and disposing first to fourth pixel electrodes in the first to fourth pixel areas, respectively, wherein the first to fourth color filters are between the first to fourth pixel electrodes and the first substrate;

wherein a first area of the display panel includes the contact point and a portion of each of the first to fourth color filters; and the first color filter among the first to fourth color filters includes a protruding portion which extends from the pixel area of the first color filter to the first area of an adjacent pixel area, wherein the protruding portion has a three-fourths quadrant circular shape in a plan view one quadrant of the protruding portion overlaps the second color filter among the four adjacent color filters in the first area, another quadrant overlaps the third color filter among the four adjacent color filters in the first area, and a remaining quadrant overlaps the fourth color filter among the four adjacent color filters in the first area.

* * * * *